United States Patent [19]

Beynet

[11] Patent Number: 4,474,244

[45] Date of Patent: Oct. 2, 1984

[54] DOWNHOLE IMPACT WRENCH

[75] Inventor: Pierre A. Beynet, Tulsa, Okla.

[73] Assignee: Standard Oil Company, Chicago, Ill.

[21] Appl. No.: 422,108

[22] Filed: Sep. 23, 1982

[51] Int. Cl.[3] ..... E21B 31/113

[52] U.S. Cl. ..... 166/377; 166/178; 166/117.7

[58] Field of Search ..... 166/377, 117.7, 178, 166/98; 81/57.18, 57.19, 57.21, 57.34, 463, 466; 294/86.15, 86.25; 175/298, 296; 173/93, 93.7

[56] References Cited

U.S. PATENT DOCUMENTS

| | | | |
|---|---|---|---|
| 2,739,654 | 3/1956 | Kinley et al. | 166/178 X |
| 2,947,520 | 8/1960 | Tappmeyer | 166/117.7 |
| 3,322,006 | 5/1967 | Brown | 166/117.7 X |
| 3,380,528 | 4/1968 | Timmons | 166/117.7 X |
| 3,434,543 | 3/1969 | Webb | 166/117.7 X |

*Primary Examiner*—Stephen J. Novosad
*Assistant Examiner*—Michael Starinsky
*Attorney, Agent, or Firm*—John D. Gassett; Fred E. Hook

[57] ABSTRACT

This invention concerns an impact wrench for breaking a threaded connection between a first section of pipe and a second section of pipe. It includes an arcuate gripping member having an exterior gripping means for gripping the inside of the first section of pipe and an impact tool for directing multiple sudden distinct forces of torque through said gripping means to the first section. It also includes a second arcuate gripping member for gripping the interior of the second section of pipe which is connected to the first and means for the second arcuate gripping member to receive the reaction torque from the impact tool.

6 Claims, 4 Drawing Figures

DOWNHOLE IMPACT WRENCH

BACKGROUND OF THE INVENTION

One method of drilling in offshore marine locations involves the use of vertically moored or tension leg platforms. In the vertically moored platform it is proposed to anchor the floating platform to the ground by tubular members. These tubular members are normally called riser pipes and may each be 1000 to 3000 feet or more in length depending upon the depth of the water. These riser pipes are made up of a large number of shorter sections of joints of pipe, e.g., 60 feet in length. It is frequently desired to connect these sections of pipe by the use of threaded joints. These sections of pipe can be screwed together at the surface as the riser pipes are run. However, the lower end of each riser pipe is connected to an anchor, such as a companion casing set or cemented in the bottom of the body of water. This can be connected by various means such as the J-slot connection or by threaded connection. In some instances it is believed that the threaded connection has advantages. This invention relates primarily to the threaded connection.

SUMMARY OF THE INVENTION

This invention relates to a new and improved apparatus and method including an impact wrench for breaking a threaded connection between a first section of pipe and a second section. It includes an arcuate gripping member having an exterior gripping means for gripping the inside of the first section of pipe and an impact tool for directing multiple sudden distinct bursts of torque through the gripping means to the first section. In one embodiment there is also a second arcuate gripping member having exterior gripping means for gripping the inside of the lower section of pipe. There are means connecting the second arcuate gripping member to the impact tool for absorbing its reaction thrust. The impact wrench may be suspended on the lower end of a string of drill pipe and hydraulic fluid or air may be circulated down through the drill pipe to actuate the gripping member and the impact tool. This invention can be used either to tighten or release the threaded joint.

DETAILED DESCRIPTION OF THE INVENTION

Figure 1:
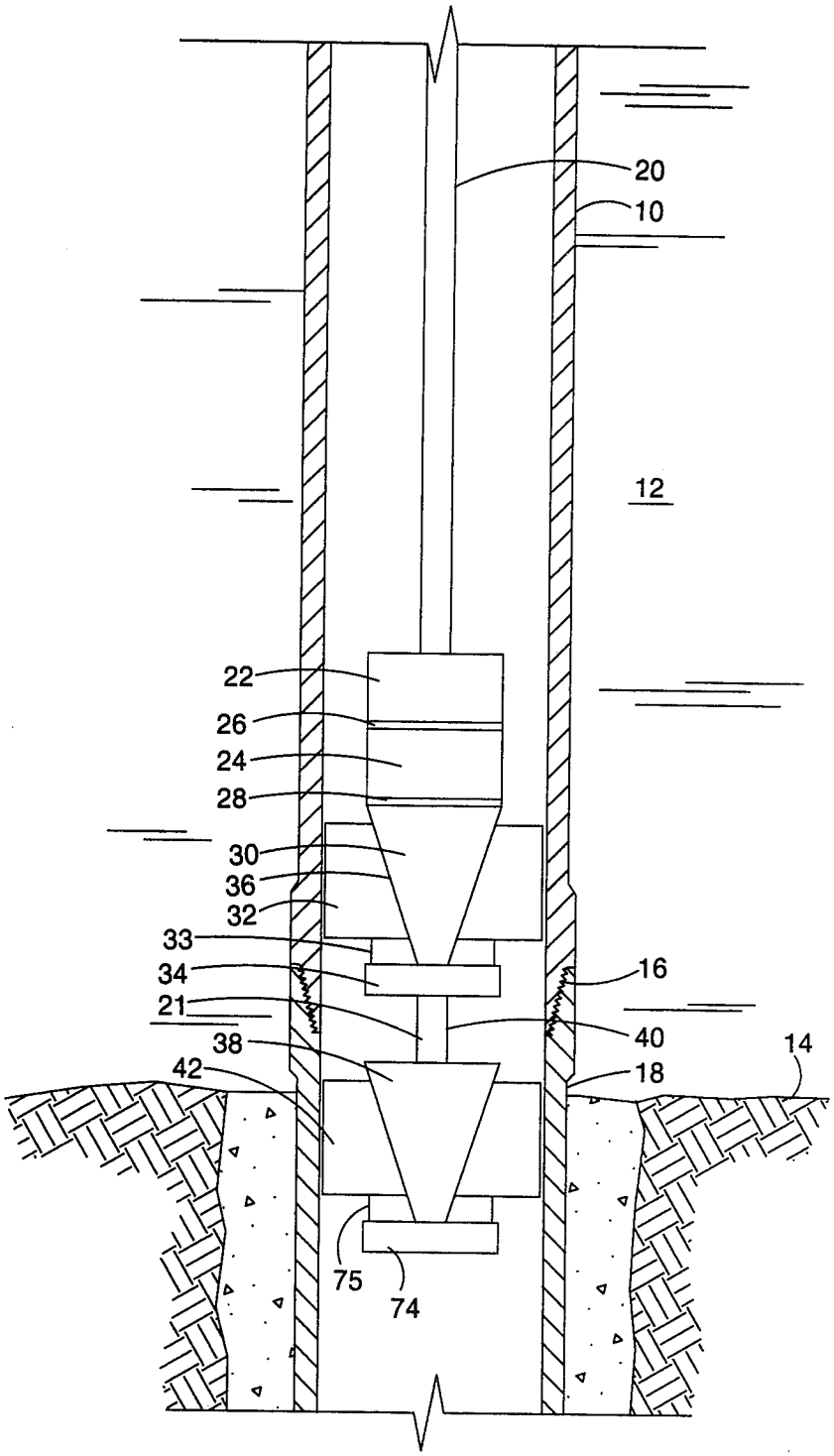
FIG. 1 is a view of the apparatus suspended in a tubular member with its lower end threadedly connected to a casing cemented in the bottom of a body of water.

Attention is first directed to FIG. 1 which illustrates a tubular member 10 suspended from a floating platform not shown and supported in a body of water 12 having a bottom 14. Riser pipe 10 is connected through threaded joint 16 to a conductor pipe 18 which is set in the bottom of the body of water 14. The apparatus of the invention is suspended on drill pipe 20 and includes a hydraulic motor 22, a hammer 24 connected to the motor by clutch 26. The hammer 24 is connected through an impact mechanism 28 to strike anvil 30.

The anvil 30 is provided with gripping wedges 32 which are actuated by a hydraulic motor or ram 34 having rod 33 which forces the gripping member 32 upwardly along inclined face 36 of the anvil until the gripping means encounters the internal wall of the riser pipe 10. Also shown is a backup mass 38 which is connected by rod number 21 to hammer 24. Mass 38 has gripping members 42 which are similar to gripping members 32. In operation, the tool is lowered to the position shown in FIG. 1 and by means which will be explained later, the gripping means 32 and 42 are actuated by hydraulic ram 34 and rod 33 and ram 74 and rod 75 so that they grip sections of pipe 10 and 18 respectively. Then, motor 22 is actuated to cause hammer 24 to repeatedly strike anvil 30 which transmits the sudden burst of angular momentum to the riser pipe section 10. In the particular embodiment shown the backup mass 38 absorbs a part of the reaction torque from motor 22. The hammer 24 can be actuated by motor 22 in either direction so it can either loosen or tighten the threaded connection 16.

Figure 2:
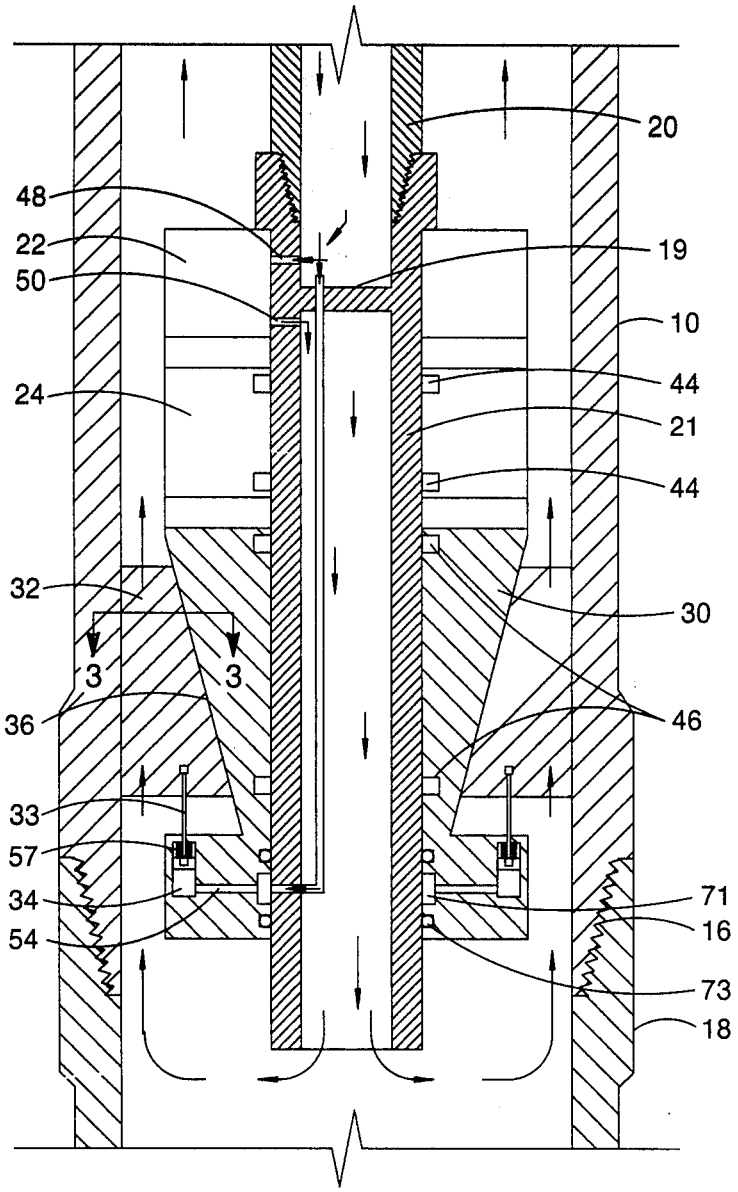
FIG. 2 is a schematic drawing showing the apparatus suspended in a tubular member just above a threaded connection.
Figure 3:
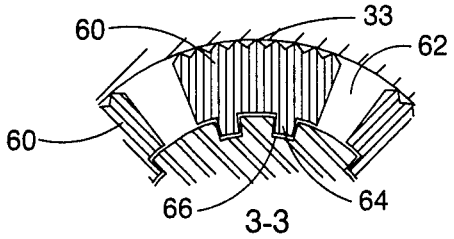
FIG. 3 is a view taken along the line 3—3 of FIG. 2.

Attention is next directed to FIGS. 2 and 3 which show the preferred embodiment of the invention. It should be noted that similar parts throughout the drawings and specifications will ordinarily be given the same numbers. In FIG. 2 hydraulic motor 22 is rigidly connected to a rigid rod 21 extending downwardly from drill pipe 20. Hammer 24 is rotatably mounted on rod 21 through bearing means 44. Rod 21 may be merely an extension of drill pipe 20 below closure 19. Anvil 30 is rotatably mounted on rod 21 by bearing means 46.

In operation, the apparatus of FIG. 2 is lowered in the riser pipe 10 until it reaches the level just above joint 16 as indicated in FIG. 2. At this time it may be actuated by forcing hydraulic fluid under pressure down the drill pipe 20. This hydraulic fluid does two things. It actuates the motor 22 and causes gripping means 32 to become wedged against the inner wall of riser pipe 10. This is accomplished by having fluid passage 48 connect the inside of drill pipe 20 to the power intake on hydraulic motor 22. A plug 19 closes the lower section of drill pipe 20 at about the level of the motor 22. An outlet 50 is provided for the spent hydraulic fluid from hydraulic motor 22. The spent fluid goes down drill pipe 20 below plug 19 to its open end and returns up the annulus between drill pipe 20 and riser pipe 10. A tubing 54 and a swivel 71 with seals 73 are used to transmit power fluid from drill pipe 20 at any rotational position of anvil 30 with respect to drill pipe 20. Fluid from drill pipe 20 is used to actuate hydraulic ram 34 which has rod 33 which drives wedge 32 upwardly along inclined plane 36 of the anvil 30 until the teeth 33 (shown in FIG. 3) engages the inner wall of the riser pipe 10. It is practical to engage the gripping wedges 32 before actuating the hydraulic motor 22. This can be easily accomplished by designing the system so that a lower pressure will engage the gripping means 32 from the pressure required for operating the hydraulic motor 22. For example, 100 pound per square inch pressure could be adequate to engage the gripping wedges whereas a higher pressure of 200 to 500 pounds per square inch for example could be required to start the hydraulic motor 22.

FIG. 3 shows section along the line 3—3. The gripping wedge 32 is really made of several arcuate or split sections or dogs 60 which have space 62 therebetween. Dog 60 must be able to move along anvil 30 but also transmit torque. This is really accomplished by providing splines 64 of the dog 30 in combination with the longitudinal groove 66 of anvil 30. The gripping wedges 32 have a space 62 therebetween so that the spent hydraulic or power fluid can be returned up the annulus between the drill pipe 20 and the riser pipe 10. Hydraulic ram 34 has a spring 57 which urges rod 33 downwardly so that when pressure is relieved, the wedge will retract, i.e., move downwardly, and release teeth 33.

There are many commercially available impact mechanism for applying torque type bursts of energy to an object. One such device is the impact wrench which mechanics use to tighten or remove the nuts from the studs when mounting a wheel on an automobile. The working cycle of the impact mechanism is well known. The same principles would apply here. The working cycle of the impact mechanism is described in a brochure "Atlas Copac" Reg Code ABH11 01-192 by Atlas Copac Tools AB-Stockholm, Sweden. Craftsman pneumatics impact wrenches are available from Sears, Roebuck and Co. The most common fluid for driving the impact tools is air.

As an example, the tool of FIG. 2 may be used to break threaded connection 16. In this example, riser pipe 10 has been threadedly connected to pipe 18 which may be a large steel conduit secured in the bottom of the body of water. The device is lowered on drill string 20 until anvil 30 and gripping means 32 are just above threaded connection 16. In setting riser pipes 10, it is common practice to keep a very accurate record of the number of sections and their length run so that one can know the exact distance from the floating vessel to threaded joint 16. The drill pipe 20 is then added on until it is of sufficient length so that the anvil and wedge gripping means are at the proper location such as shown in FIG. 2. At this time a suitable power fluid such as air or drilling mud is pumped down drill pipe 20 and goes through conduit 54 to ram 34 which then drives the wedge 32 upwardly until the gripping means 33 engages the interior wall of riser pipe 10. This may be accomplished by a low pressure, e.g., 100 psi. Then additional fluid pressure will be used to operate motor 22. Back pressure valves or flow check valves can be used in conduit 48 that would prevent passage of air until the pressure reaches a pressure greater than that required to actuate and set the gripping wedges 33. A small torque can then be applied directly on the upper joint of riser 10 at the upper end at the surface on a drill ship not shown to facilitate the operation. When sufficient pressure has been applied to the air to operate hydraulic motor 22, it causes hammer 24 to repeatedly provide multiple bursts of torque through the anvil and gripping means 33 to the riser pipe 10. The direction of the torque would be such as to unscrew thread 16. Drill pipe 20 may provide the reaction for hydraulic motor 22. In fact, in some instances it might be possible to use a flexible pipe 20 in place of the normal steel drill pipe. With the sudden bursts or torque impact provided for motor 22 there can be a significant impact torque applied to riser pipe 10 to break the threaded joint 16. This principle can be illustrated by one sitting in a swivel chair with one's feet and arms above the floor and touching no object. By proper manipulation of the arms and legs, one can make the chair rotate. After threaded joint 16 has been "broken" the pressure on hydraulic ram 34 can be reduced and spring 57 will cause the ram to retract, thus freeing the anvil from the riser pipe 10. The apparatus can then be raised by drill pipe 20 and the riser pipe 10 can then be unscrewed from the surface. It is to be noted that if the gripping wedges 33 tend to become stuck and it is difficult for spring 57 to disengage them, the device can be released nevertheless. This can be accomplished by lifting up on drill pipe 20 and the inwardly and downwardly slope of the anvil will cause it to ride up over the wedge 32. Once the anvil is raised, then the anvil should move away from the wall of the riser pipe 10 sufficiently to disengage the gripping means or teeth 33. If there should be a desire to tighten a threaded joint 16, the same procedure can be applied except that the motor 22 will operate in the opposite direction. Reversible type motors and impact wrenches are well known.

Figure 4:
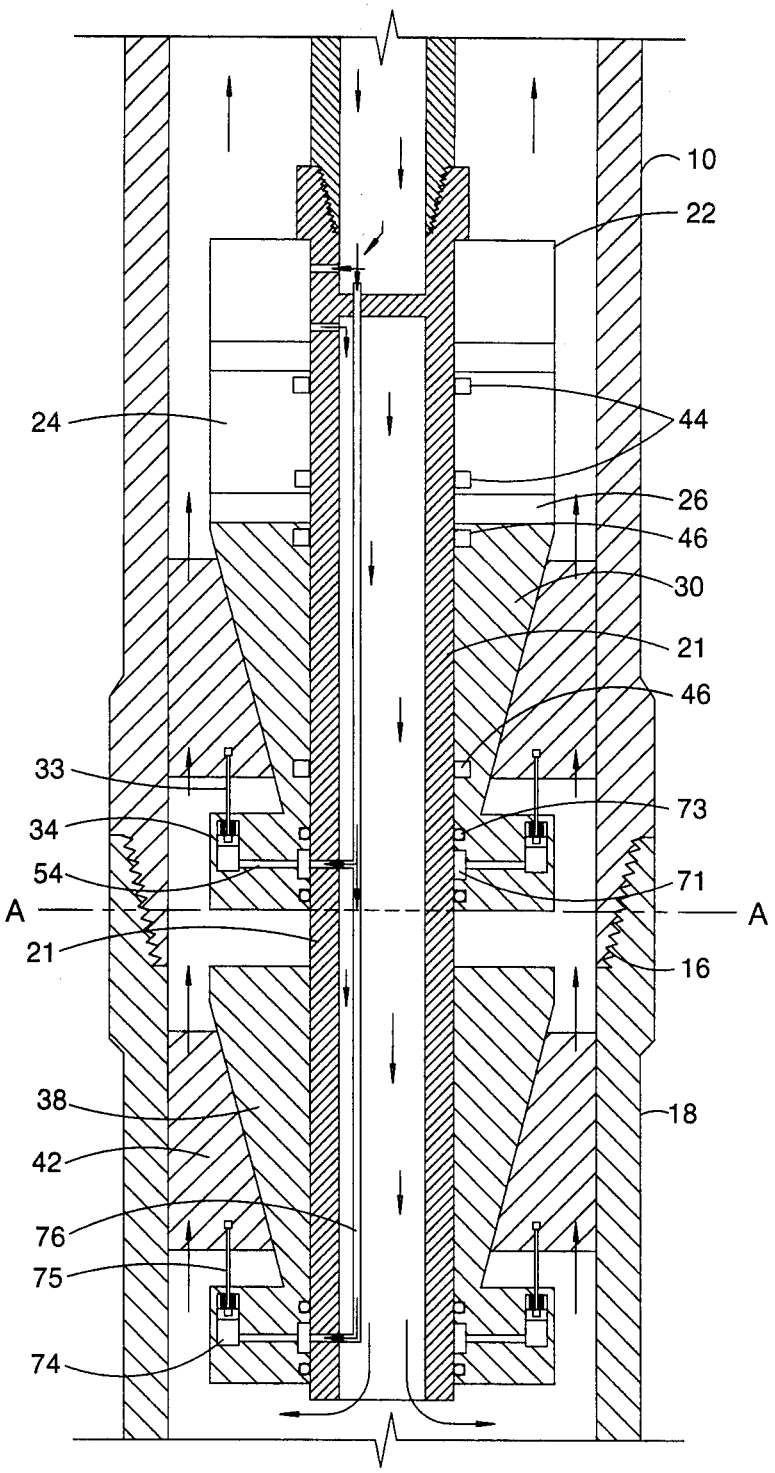
FIG. 4 is similar to FIG. 2 except it has a backup mass added to the lower end thereof.

Attention is next directed to FIG. 4 which is quite similar to the FIG. 2. That portion of FIG. 4 above line A—A is essentially identical to FIG. 2. Added thereto is a backup mass 38 which is rigidly attached to rod 21 whereas anvil 30 was rotatively mounted on rod 21. Motor 22 is also rigidly mounted to rod 21. Thus, backup mass 38 adds mass to the motor 22 for absorbing reaction force. Backup mass 38 is also provided with a gripping wedge means 42 which can be identical to wedge 32. Hydraulic ram 74 can be similar to hydraulic ram 34 and is connected to line 54 by extension conduit 76. In this apparatus of FIG. 4 the wedge 32 of the anvil 30 and the wedge 42 of the backup mass 38 are simultaneously actuated. In operation, the device of FIG. 4 is lowered by drill pipe 20 until it reaches the position essentially as shown in FIG. 4 wherein the anvil 30 is above threaded connected 16 and the backup mass 38 is below such connection. Then, in operations, the wedges 32 and 42 are set by applying pressure through conduits 54 and 76 respectively. Any reaction force from motor 22 is transmitted through rod 21 and backup mass 38 to the lower pipe section 18. In the apparatus of FIG. 4, one burst of torque can be applied by hammer 24 through anvil 30 to riser pipe 10 just above threaded connection 16 and the reaction of this force can be transmitted through the motor 22, rod 21, backup mass 38 and wedge 42 to the conduit 18 which makes up the lower part of the threaded connection 16. If desired, backup mass 38 can be rotatably mounted on rod 21 and thus be rotatable with respect to motor 22. This arrangement adds backup mass to the lower Section 18 and functions typically like the anvil of a blacksmith.

When a threaded connection such as 16 is set in a wellbore for a long period of time such as several years, it tends to become set. This is not too uncommon with many threaded joints such as bolts on ordinary equipment especially when exposed to adverse environmental conditions. Thus, there is a real need for the system of this invention.

While the invention has been described with a certain degree of particularity, it is manifest that many changes may be made in the details of construction and the arrangement of components without departing from the spirit or scope of this disclosure. It is to be understood that the invention is not limited to the specific embodiment set forth herein but it is to be limited only by the scope of the attached claim or claims, including the full range of equivalency to which each element thereof is entitled.

What is claimed:

1. An impact wrench for breaking a threaded connection between a first and a second section of pipe which comprises:

(A) an upper member insertible in said pipe and having:

(1) first exterior gripping means for gripping the inside of a first section of pipe;

(2) an impact tool for directing a sudden torque through said gripping means to said first section;

(B) a lower member insertible into said pipe and having:

(1) second exterior gripping means for gripping the inside of said second section;

(2) a connecting member between said upper member and said lower member to transmit reaction torque from the impact tool of said first member through the second exterior gripping means to said second section of pipe.

2. A downhole impact wrench for breaking the threaded connection between a first joint of pipe and a second joint of pipe which comprises:

a fluid motor;

a hammer connected to said motor for striking repeated blows whose direction of force is perpendicular to the longitudinal axis of said joint of pipe;

an anvil connected to receive the blows from said hammer, said anvil to have a downwardly and inwardly sloping exterior;

an arcuate wedge comprising a plurality of segments, each such segment mating with the exterior surface of said anvil and having teeth on the exterior thereof;

hydraulic ram means to force said wedge upwardly along said anvil to engage the interior wall to the joint of pipe;

power conduit means connecting the fluid motor and the means for moving said wedge to the interior of said drill pipe;

said motor requiring a higher pressure to be operateable than said hydraulic ram.

3. An apparatus as defined in claim 2 in which said hydraulic ram includes means to urge said wedge downwardly when the pressure in said power conduit means is relieved.

4. An apparatus as defined in claims 2 or 3 including a backup mass having a gripping means for gripping the interior of a second section of pipe and a rigid rod rigidly connecting said backup mass to said motor.

5. An apparatus as defined in claims 2 or 3 including a backup mass having a gripping means for gripping the interior of a second section of pipe, said backup mass being supported from said motor and free to rotate with respect thereto.

6. A method of unscrewing a threaded connection between an upper section of conduit suspended from a drilling vessel and a lower section of conduit fixedly set in the bottom of a body of water, which comprises:

positioning an impact tool in the vicinity of the threaded connection to be released;

applying a series of distinct impact blows to apply torque to said upper section;

and applying the reaction torque from said blows to said lower section of pipe.

* * * * *